US006951992B2

(12) United States Patent
Yan et al.

(10) Patent No.: US 6,951,992 B2
(45) Date of Patent: Oct. 4, 2005

(54) CORONA AND STATIC ELECTRODE ASSEMBLY

(75) Inventors: Eric S. Yan, Orange Park, FL (US); Kevin R. McHenry, Jacksonville, FL (US)

(73) Assignee: Outokumpu Oyj, Espoo (FI)

( * ) Notice: Subject to any disclaimer, the term of this patent is extended or adjusted under 35 U.S.C. 154(b) by 229 days.

(21) Appl. No.: 10/376,190

(22) Filed: Feb. 27, 2003

(65) Prior Publication Data

US 2003/0192814 A1 Oct. 16, 2003

Related U.S. Application Data

(63) Continuation-in-part of application No. 10/120,017, filed on Apr. 10, 2002, now Pat. No. 6,797,908.

(51) Int. Cl.[7] ..... B03C 7/01

(52) U.S. Cl. ..... 209/127.1; 209/128; 209/127.2; 209/130; 209/129

(58) Field of Search ..... 209/127.1, 127.2, 209/127.3, 127.4, 128, 129, 130, 131

(56) References Cited

U.S. PATENT DOCUMENTS

| | | | | | |
|---|---|---|---|---|---|
| 827,115 | A | * | 7/1906 | Pickard | 209/127.2 |
| 1,178,430 | A | * | 4/1916 | Wentworth | 209/130 |
| 2,314,940 | A | * | 3/1943 | Hewitt | 209/127.1 |
| 2,737,348 | A | * | 3/1956 | Roberts | 241/24.13 |
| 3,322,275 | A | * | 5/1967 | Breakiron et al. | 209/127.1 |
| 3,969,225 | A | * | 7/1976 | Horowitz | 209/127.2 |
| 3,998,727 | A | * | 12/1976 | Giffard | 209/127.1 |
| 4,100,068 | A | * | 7/1978 | Jordan et al. | 209/127.1 |
| 4,341,744 | A | * | 7/1982 | Brison et al. | 423/206.2 |
| 4,375,454 | A | * | 3/1983 | Imperto et al. | 423/206.2 |
| 5,161,696 | A | * | 11/1992 | Seider | 209/127.4 |
| 5,967,331 | A | * | 10/1999 | Katyshev et al. | 209/127.4 |
| 6,271,492 | B1 | * | 8/2001 | Maehata et al. | 209/127.1 |
| 6,390,302 | B1 | * | 5/2002 | Abrarov et al. | 209/12.2 |
| 6,720,514 | B1 | * | 4/2004 | Inoue et al. | 209/128 |
| 6,797,908 | B2 | * | 9/2004 | Yan et al. | 209/131 |

FOREIGN PATENT DOCUMENTS

| | | | | |
|---|---|---|---|---|
| WO | WO 85/02355 | * | 6/1985 | B03C/7/06 |

* cited by examiner

*Primary Examiner*—Donald P. Walsh
*Assistant Examiner*—Jonathan R Miller
(74) *Attorney, Agent, or Firm*—Arthur G. Yeager

(57) ABSTRACT

A corona and static electrode assembly is attachable to a frame of an existing electrostatic separator and includes a pair of oppositely spaced end panels and an elongate corona support member disposed inwardly of and supported by the respective end panels. The corona support member is preferably formed from a single piece of rigid material and has a substantially L-shape for directing an electrostatic field intensity towards the outer surface of a rotating drum. A pair of spaced spacers are connected to and laterally extend from the corona support member and an elongate conductive wire extends between the pair of spacers. The wire is preferably supported between the spacers and threaded bolts passing therethrough, respectively, can adjust its tension. A plurality of elongate static electrodes are spaced from the wire and are connected between the pair of end panels. The assembly may further include a pair of end shields, a pair of support members and an elongate support member for assisting to maintain the corona support member and static electrodes in a fixed position and for attaching the assembly to a frame of an existing electrostatic separator.

23 Claims, 10 Drawing Sheets

CORONA AND STATIC ELECTRODE ASSEMBLY

CROSS REFERENCE TO RELATED APPLICATIONS

The present patent application is a continuation-in-part application of U.S. patent application Ser. No. 10/120,017 filed on Apr. 10, 2002 now U.S. Pat. No. 6,797,908, entitled "High-Tension Electrostatic Classifier and Separator, and Associated Method".

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a corona and static electrode assembly and, more particularly, to a corona and static electrode assembly attachable to prior art high-tension electrostatic separators.

2. Prior Art

It is well known in prior art that high-tension, roll-type electrostatic separators having a corona and static electrode assembly are more suitable for separating particulate materials sized coarser than 74 $\mu$m, as disclosed in applicant's pending U.S. patent application Ser. No. 10/120,017, for example. A significant problem with such roll-type separators is that the fine conducting particulate materials remain on the roll surface and are misplaced with nonconducting particulate materials. In part, this can be attributed to fine particulate materials having high surface charges, less inertia/centrifugal forces, as well as being susceptible to particle entrapment. The separation efficiency is also impacted by the arrangement of the corona and static electrode assembly.

To improve the efficiency of such roll-type separators, various corona and static electrode assemblies have been proposed. Unfortunately, a shortcoming of such prior art assemblies is their low separation efficiency. Therefore, there is a need to provide an improved corona and static electrode assembly to enhance the separation efficiency of high-tension, roll-type electrostatic separators. Such an improved assembly should be attachable to existing electrostatic separators, as an after market assembly, and should provide better particle charging capability as well as better field intensity for particle separation.

BRIEF SUMMARY OF THE INVENTION

In view of the foregoing background, it is therefore an object of the present invention to provide an improved corona and static electrode assembly for use in high-tension, roll-type electrostatic separators. These and other objects, features, and advantages of the present invention are provided by an electrode assembly including a pair of oppositely spaced end panels, an elongate corona support member having opposed end portions disposed inwardly of and supported by respective end panels, a pair of spaced spacers connected to and laterally extending from the corona support member, an elongate conductive wire extending along a length of the corona support member and extending between the pair of spacers, means for supporting the wire between the spacers and for adjusting a tension of the wire to a predetermined tension, and a plurality of elongate static electrodes spaced from the wire and extending substantially parallel to the wire.

The plurality of static electrodes are preferably spaced from each other and have opposite end portions connected to the pair of end panels. The end panels have a plurality of spaced holes respectively receiving the static electrodes therethrough and for supporting same in a substantially parallel arrangement to each other. An elongate mounting support member is preferably spaced from the corona support and extends through and outwardly of the end panels.

The corona assembly may further include at least one conductive plate attached to one end panel and engages an end of each electrode to enhance uniform electrification of the wire and the static electrodes. Each spacer may have an edge portion disposed spacedly away from the corona support member and each spacer may further have an aperture extending through each edge portion for receiving a bolt therethrough.

The means for supporting the wire preferably includes a pair of threaded bolts with each bolt having its threaded end passing through respective apertures and having a passageway extending laterally through its bolt head for receiving and maintaining an end of the wire, respectively. The bolts are preferably rotatable to wrap the wire therearound and adjust tension of the wire.

The corona assembly may further include a pair of end connectors attached between respective end portions of the corona support member and end panels. The end connectors may have a pair of threaded holes aligned with each other respectively for receiving the respective bolts therethrough. Each of the end panels may have a substantially planar inner surface for connecting to at least one conductive plate. Such a plate may have a plurality of spaced holes aligned with the respective holes of the end panels and for receiving the end portions of the plurality of static electrodes therethrough.

The corona assembly may further includes at least one support panel spaced along the length of the corona support member and have a notch for receiving the corona support member therethrough and for maintaining same in a fixed position. The at least one support panel may have a hole therethrough for receiving and maintaining the elongate mounting support member parallel to the support members. The corona support member has a central longitudinal axis wherein the corona support member is selectively rotatable thereabout.

The corona assembly may further include a pair of opposed end shields spaced outwardly from respective end panels with the mounting support member passing through and being connected to the end shields. Each end shield may include a first slot for receiving a corresponding end of the elongate mounting support member to thereby adjustably position the assembly on a frame of an electrostatic separator. A pair of threaded fasteners each have one end connected to the end panels respectively. The end shields may further include respective second slots spaced from the first slots with the threaded fasteners being removably attachable to the second slots for assisting to connect the end shields to the end panels respectively.

The corona support member may be formed from a single piece of material angled to form a substantially L-shape. The plurality of static electrodes may be coated with nonconductive material. The corona support member and the end panels may be covered with dielectric material and the spacers may be formed from dielectric material. The end connectors may be coated with insulating material.

BRIEF DESCRIPTION OF THE SEVERAL VIEWS OF THE DRAWING

The novel features believed to be characteristic of the present invention are set forth with particularity in the appended claims. The invention itself, however, both as to its construction and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

The present application is a continuation-in-part patent application of pending U.S. patent application Ser. No. 10/120,017, incorporated herein by reference. Such a pending application discloses and claims a high-tension electrostatic classifier and separator for separating particulate materials based upon size and conductivity. The present application is directed to an improved corona and static electrode assembly for separating particulate materials based upon conductivity and is preferably sold as an aftermarket assembly that is attachable to existing electrostatic separator devices such as applicant's above-referenced pending application, for example. It is noted that the corona and static electrode assembly of the present invention should not be construed as having limited application to any single prior art high-tension, roll-type electrostatic separator and can be fitted onto various electrostatic separators having a roll-type drum.

Figure 1:
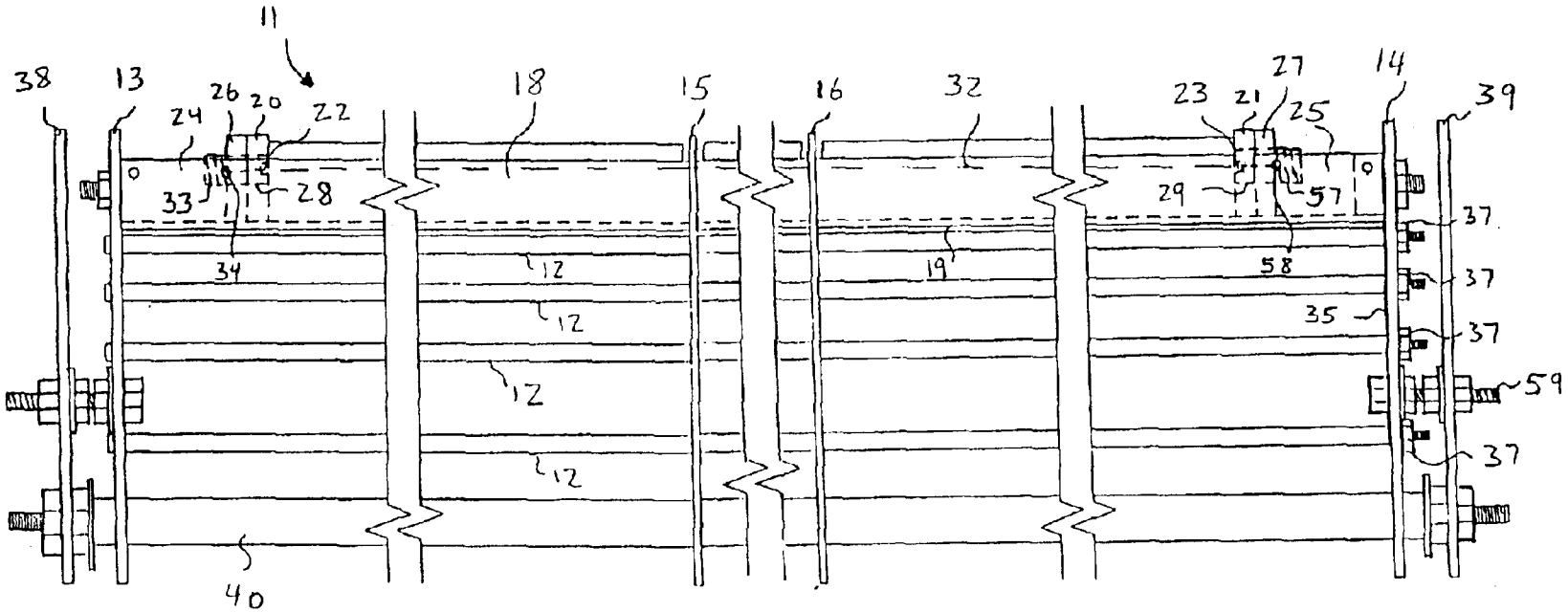
FIG. 1 is a top plan view of the corona and static electrode assembly, in accordance with the present invention.
Figure 2:
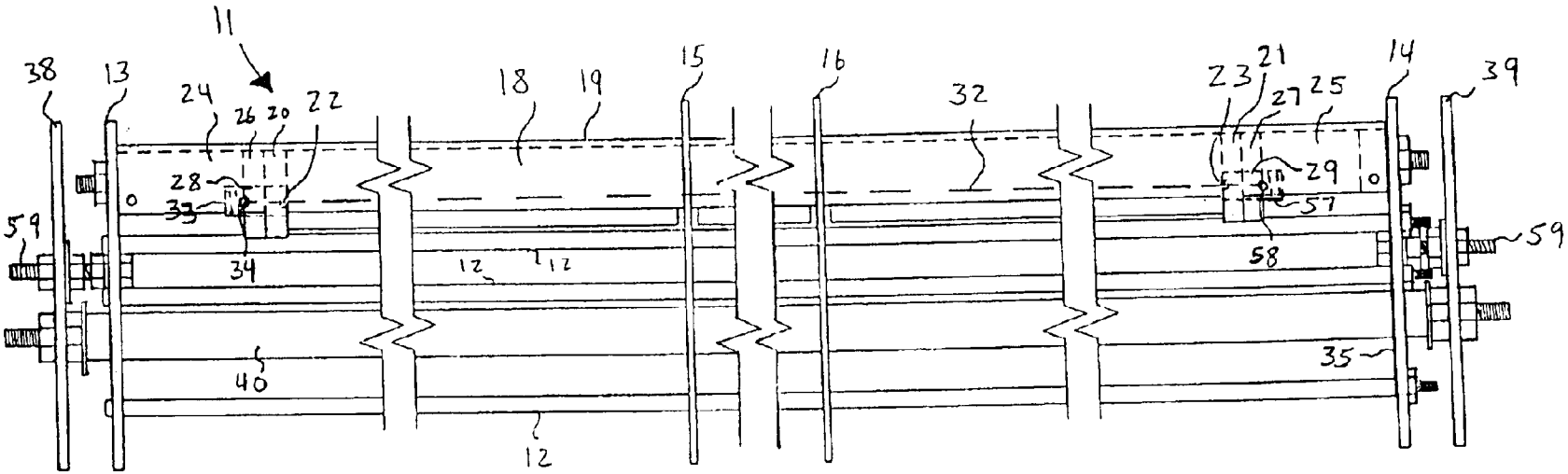
FIG. 2 is a rear elevation of view of FIG. 1.
Figure 3:
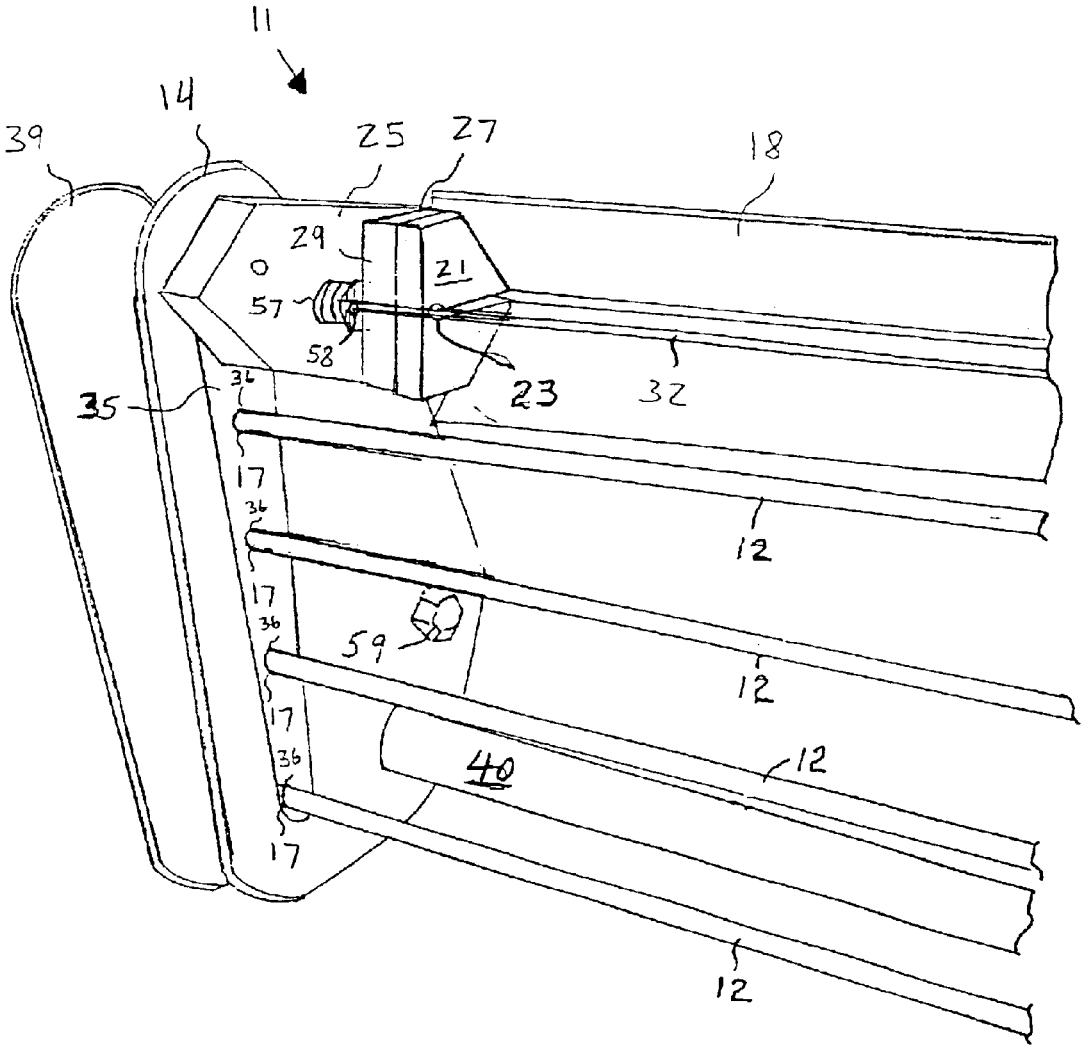
FIG. 3 is an enlarged perspective view of one end of the assembly shown in FIG. 1.

Now referring to FIGS. 1, 2 and 3, the corona and static electrode assembly of the present invention is shown at reference number 11 as including a plurality of elongate static electrodes 12 held in place by a plurality of panels 13–16. In particular, a pair of end panels 13, 14 are preferably disposed at opposite ends of the static electrodes 12 and a pair of inner panels 15, 16 are selectively spaced between the opposite ends of the static electrodes 12. Each panel 13–16 has a plurality of holes 17 for receiving a corresponding static electrode 12 therethrough.

The corona assembly 11 further includes an elongate corona support member 18 that has a generally angled shape, similar to an L-shape, and is connected between the end panels 13, 14. The corona support member 18 is preferably formed from a single piece of rigid material, e.g. aluminum, stainless steel, or thermoplastics, for example, and is disposed above the static electrodes 12 extending substantially parallel thereto. The angled L-shape of the corona support member 18 forms a substantially perpendicular corner 19 disposed at a top portion thereof, as perhaps best shown in FIG. 4.

The corona support member 18 has a pair of opposed end portions spaced inwardly from the end panels 13, 14 and are preferably supported by a pair of spacers 20, 21 positioned adjacent its end portions. Each spacer 20, 21 is angled at one side, conforming to the angled L-shape of the corona support member 18 so that the spacers 20, 21 can be positioned thereagainst for assisting to maintain the angled L-shape of the corona support member 18. The spacers 20, 21 have respective apertures 22, 23 formed at near sides thereof, respectively, and for receiving wire 32. Thus, such a wire extends between the spacers 20, 21, as perhaps best shown in FIGS. 1 and 2. The spacers 20, 21 may be positioned in an abutting relationship with the corona support member 18 and attached thereto by silicon adhesive or other suitable adhesives known in the industry, for example.

A pair of connectors 24, 25 are disposed adjacent opposite ends of the corona assembly 11 and are connected between the spacers 20, 21 and the end panels 13, 14, respectively. Such connectors 24, 25 are preferably made from aluminum or other conductive material and can be coated with nonconductive paint, well known in the industry. Each connector 24, 25 includes a respective end portion 26, 27 connected to a respective spacer 20, 21 and has a respective hole 28, 29 aligned with a respective hole 30, 31 of the spacers, respectively. Such connector holes 28, 29 receive bolts 33, 57 therethrough and the conductive wire 32 is fed through the spacer apertures 22, 23 for connecting to the bolts 33, 57, respectively, with the opposed ends of the elongate wire 32 preferably wrapped around the bolts 33, 57, respectively, and supported in place.

The bolts 33,57 are preferably threaded so that they can be rotated inwardly or outwardly for adjusting the wire tension. In particular, the bolts 33, 57 preferably have a respective hole 34, 58 transversely extending through their respective widths for receiving the wire 32 to be wrapped around a portion of the bolts 33, 57 and secured thereto. Thus, as the bolts 33, 57 are rotated in an outward manner, the wire 32 becomes wrapped therearound and its tension increases. And when the bolts 33, 57 are rotated inwardly, the wire 32 unwraps from the bolts 33, 57 and its tension decreases.

A conductive plate 35 having substantially planar sides is secured to the inner side of end panel 14 and has a plurality of holes 36 aligned with holes 17 and for receiving a corresponding end of the static electrodes 12. A fastening member such as a nut 37, as perhaps best shown in FIGS. 1 and 2, preferably threads such corresponding ends of the static electrodes 12 for connecting to end panel 14. A pair of end shields 38, 39 are disposed outwardly of the end panels 13, 14, respectively. End shield 39, which is disposed adjacent end panel 14, is preferably connected thereto by a threaded bolt 59 and pair of washers and nuts, as best shown in FIGS. 1 and 2, for example.

Similarly, opposite end shield 38 is connected to end panel 13 by a threaded bolt 59 and pair of washers and nuts. An elongate support bar 40 extends along the length of the assembly 11. Such a bar 40 extends substantially parallel to the static electrodes 12 and passes through a lower portion of the end panels 13, 14 for connecting to the end shields 38, 39, respectively. The opposed ends of the support bar 40 are preferably threaded for receiving a respective washer and nut, for example.

Figure 4:
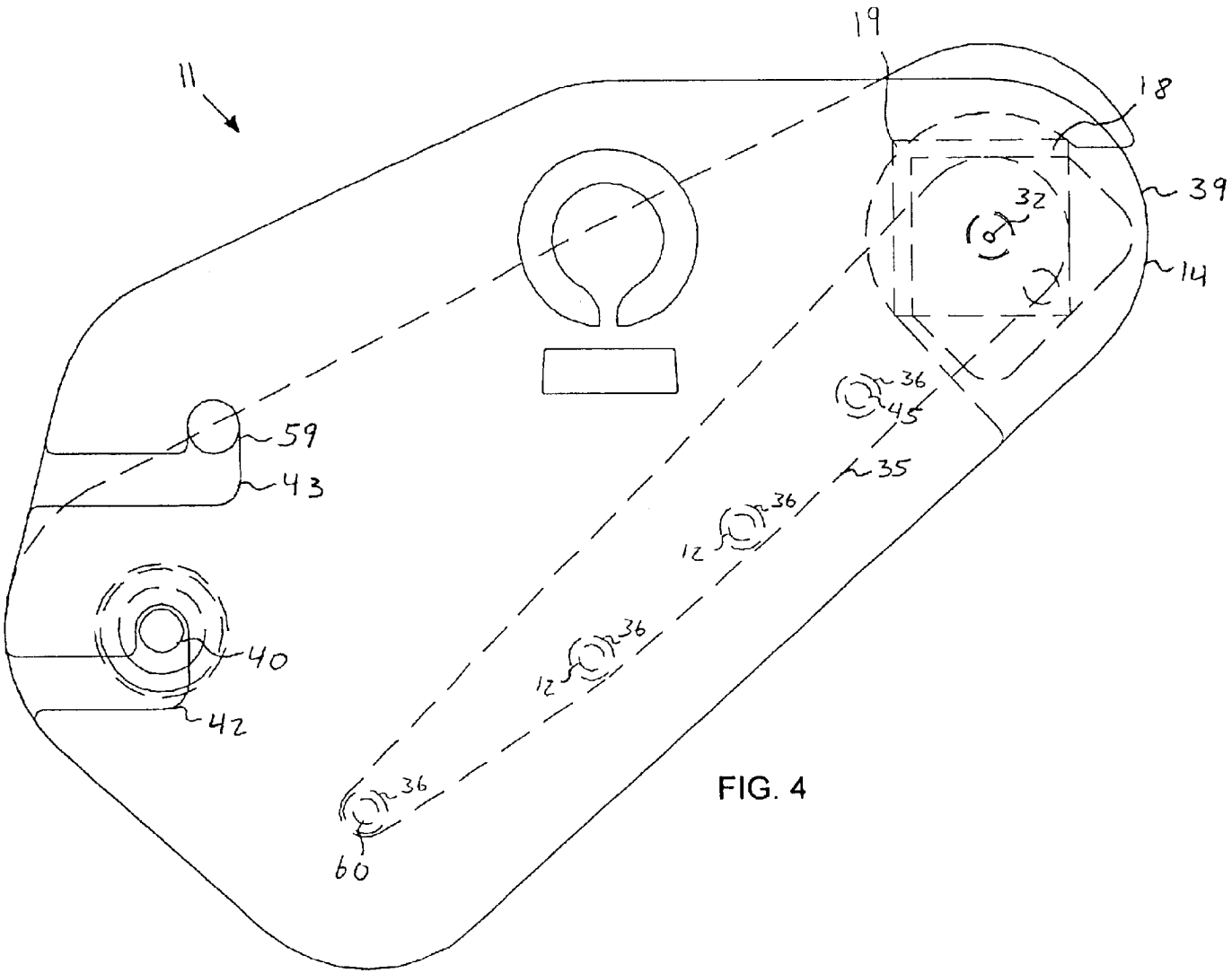
FIG. 4 is an enlarged end view of the assembly shown in FIG. 1.

Referring to FIG. 4, one end of the assembly 11 shows end panel 14 and end shield 39 as having substantially the same shape. It is noted that end panel 13 and end shield 38 are substantially similar to end panel 14 and end shield 39, as shown herein. Further, end shields 38, 39 each have a pair of slots 42, 43 that are generally L-shaped for receiving the threaded ends of the support bar 40 and threaded bolt 59 therethrough, respectively.

Figure 10:
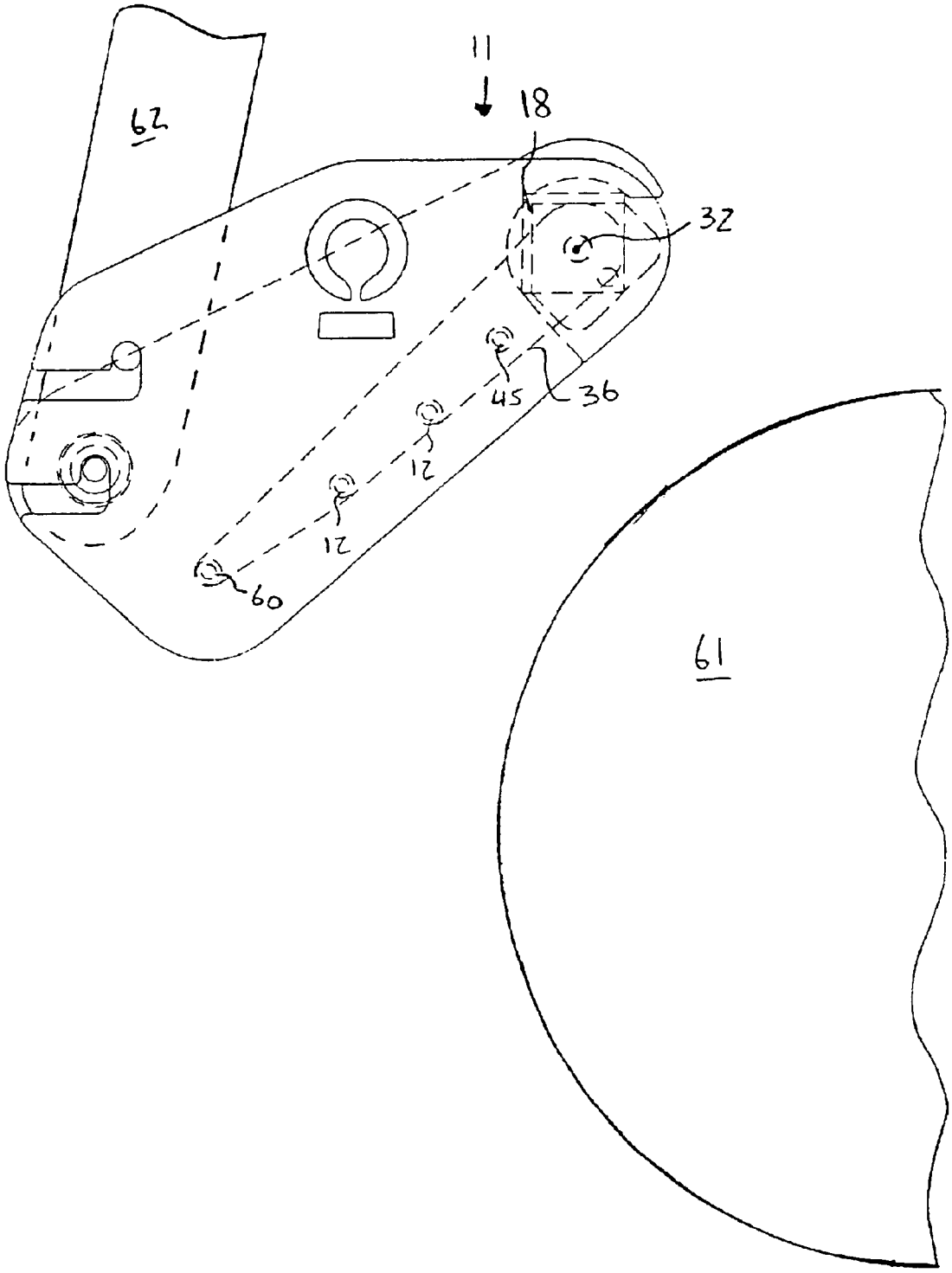
FIG. 10 is an end view of FIG. 1 showing the sloped spatial relationship of the static electrodes with the outer surface of a prior art separator drum.

The conductive plate 35 is relatively slender and extends from the top portion of the end panel 14 to the bottom portion thereof with its holes 36 being aligned with the end portions of the static electrodes generally referenced at 12. The conductive plate 35 and the corresponding end of the static electrodes 12 are positioned generally between the end panels 13, 14 adjacent to a rotating drum of a prior art electrostatic separator, as best shown in FIG. 10. In particular, static electrode 45 is disposed at the top portion of end panel 14 and nearest corona support member 18 and wire 32 and is positioned closest to a rotating drum during operating conditions. Referring to FIG. 10, after the present assembly 11 is attached to the frame 62 of a prior art electrostatic separator (not shown), such a static electrode 45 is also positioned upstream of the other static electrodes 12. Each subsequent static electrode is positioned down stream therefrom and is disposed further away from the rotating drum 61 with the lowest disposed static electrode 60 being furthest from the rotating drum 61. Thus, as particulate materials travel on the rotating drum 61, they are drawn away therefrom towards the static electrodes, generally shown at 12, to be separated and collected in separate receiving bins (not shown).

Figure 5:
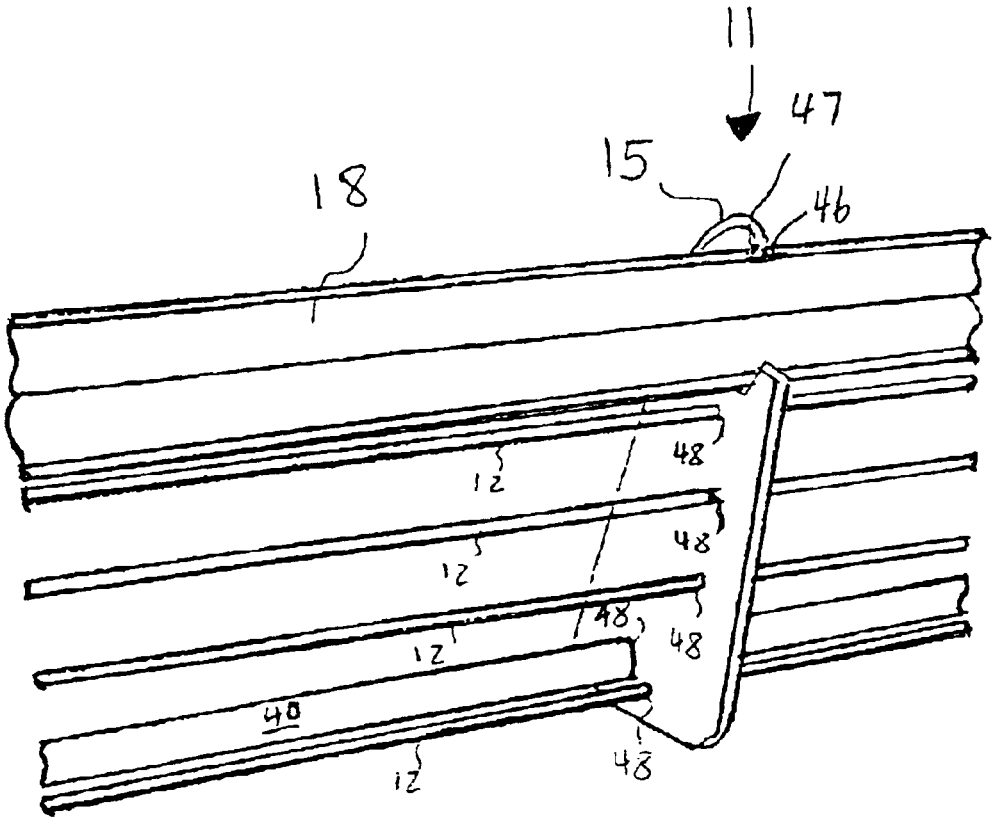
FIG. 5 is a perspective view of a portion of the assembly shown in FIG. 1.

Now referring to FIG. 5, the corona support member 18 may have a plurality of notches 46 selectively spaced along its length corresponding to the location of inner panels 15 and 16 (shown in FIGS. 1 and 2) disposed between the end portions of the corona support member 18. Such inner panels 15, 16 also have notches 47 formed in a top portion thereof for receiving the respective notches 46 of the corona support member 18 passing therethrough. Such notches 47 help maintain the corona support member 18 in a substantially fixed position during operating conditions and also permit corona-aiming adjustment by rotating the corona support member 18. The inner panels 15, 16 further have a plurality of holes 48 for receiving the static electrodes 12 and the support bar 40 therethrough and for helping them remain in a substantially fixed relationship during operating conditions. Such inner panels 15, 16 are made from insulating material such as thermoplastics, fiberglass, or G-10.

The corona support member is also preferably lined with a sheet of thin insulating material such as G-10, as known in the industry. Likewise, the support bar 40 is preferably lined or coated with insulating material, such as Teflon, so that the corona assembly 11. Each static electrode 12 is preferably coated with insulating material such as Teflon, for example. Thus, when the support bar 40 and threaded bolt 59 is connected to a frame 62 of an electrostatic separator, the entire assembly 11 becomes charged for allowing electricity to be transmitted between the corona wire 32 and static electrodes 12.

Referring back to FIGS. 1 and 2, as noted above, the assembly 11 is attachable to existing electrostatic separators as an after-market device. This can be done by removing the end shields 38, 39 from the assembly 11 and connected the opposed end portions of the support bar 40 as well the corresponding end portion of the threaded bolt 59 a frame 62 of an electrostatic separator, as well known in the industry. Once the assembly 11 is in position, the end shields 38, 39 can be reattached thereto by sliding slots 42, 43 around the threaded end portions of the support bar 40 and threaded bolt 59, respectively, and secure same in place by respective nuts, for example.

Figure 6:
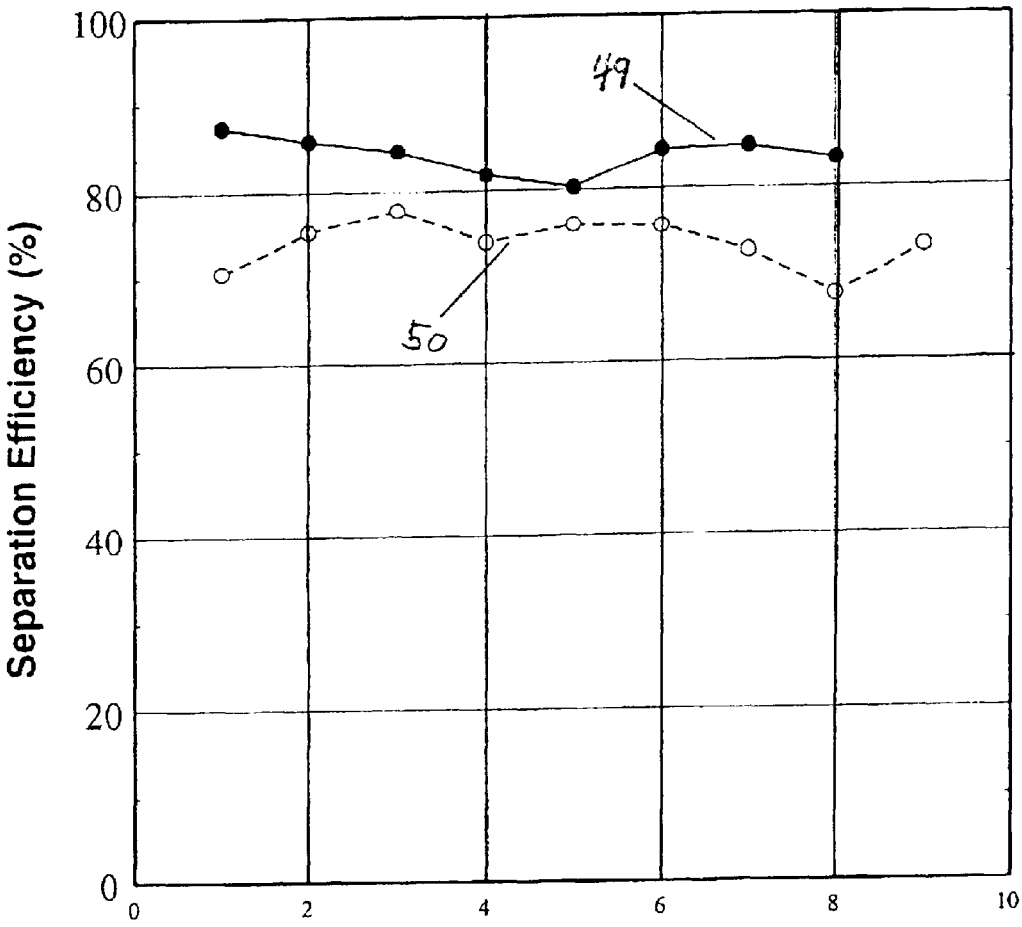
FIG. 6 illustrates the separation efficiency of a prior art electrostatic separator vs. an electrostatic separator having a corona and static electrode assembly of the present invention.

The corona and static electrode assembly 11 of the present invention has been tested and has been found to provide improved separation efficiency over similar prior art devices. In particular, referring to FIG. 6, it can be seen that the separation efficiency 50 of a prior art electrostatic separator without assembly 11 is not as high as an electrostatic separator 51 employing assembly 11. The present assembly improves separation efficiency by an average of 10%, in the range of 5% to 15% depending on the operating conditions, over prior art devices.

Figure 7:
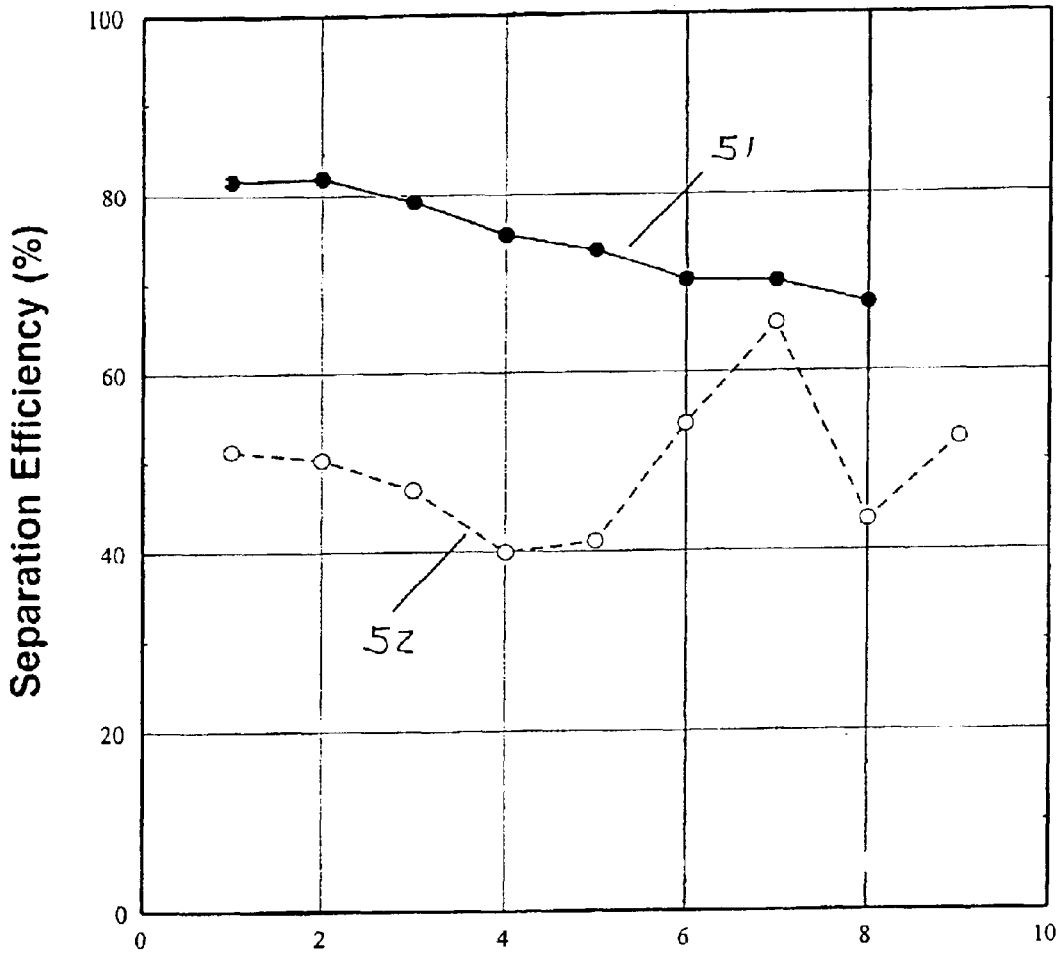
FIG. 7 illustrates the separation efficiency of FIG. 6 without considering the separation efficiency of middling particulate materials.

FIG. 7 illustrates even greater improved separation efficiency when middling stream was combined with conductor stream to measure the separator performance. Such, test runs show the present invention's separation efficiency 51 provides an averaged improvement of appoximately 15%. Points 6 and 7, on FIG. 7, were less because the tests were carried out to perform a grade-recovery evaluation therefore the separation were not optimized.

Figure 8:
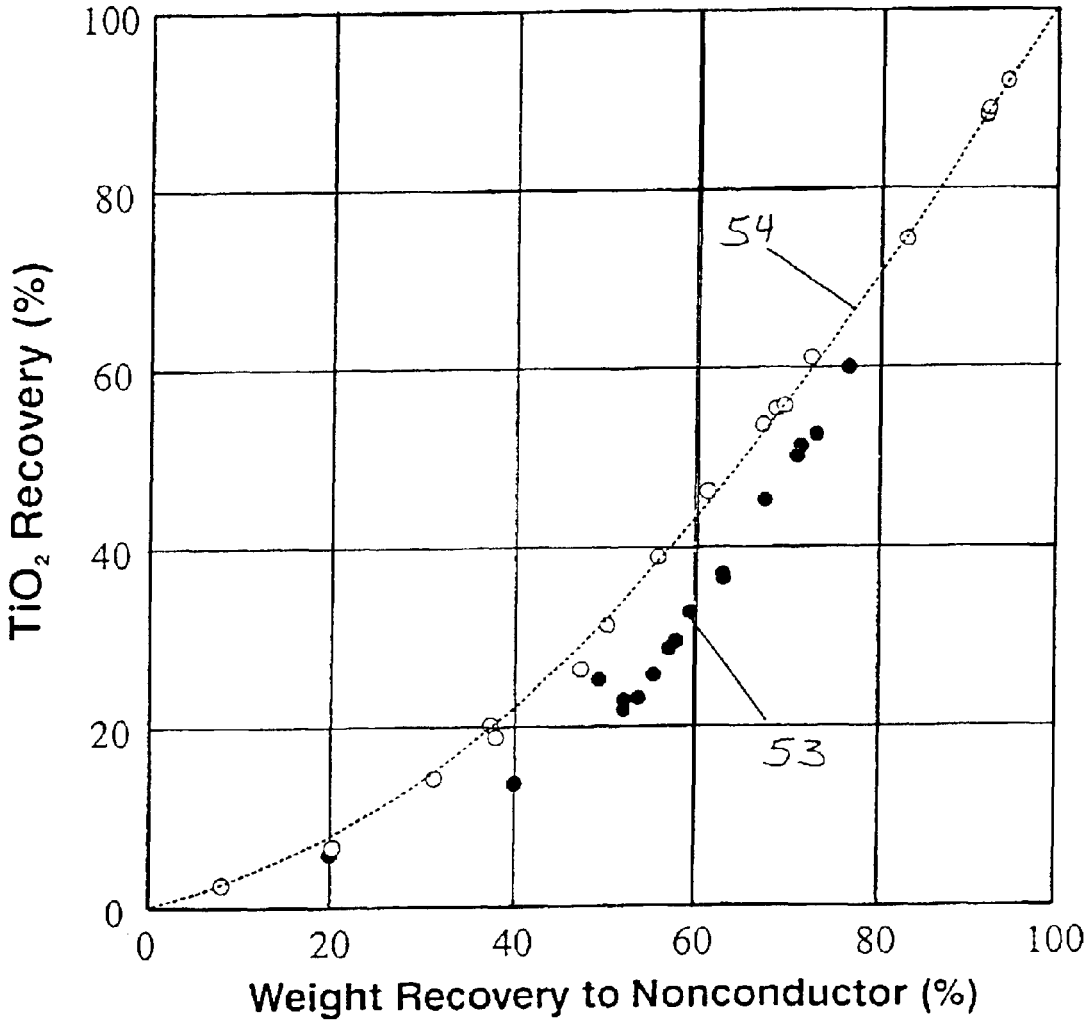
FIG. 8 illustrates the percentage recoveries of conductor $TiO_2$ to the percentage recovery by weight of nonconductors.
Figure 9:
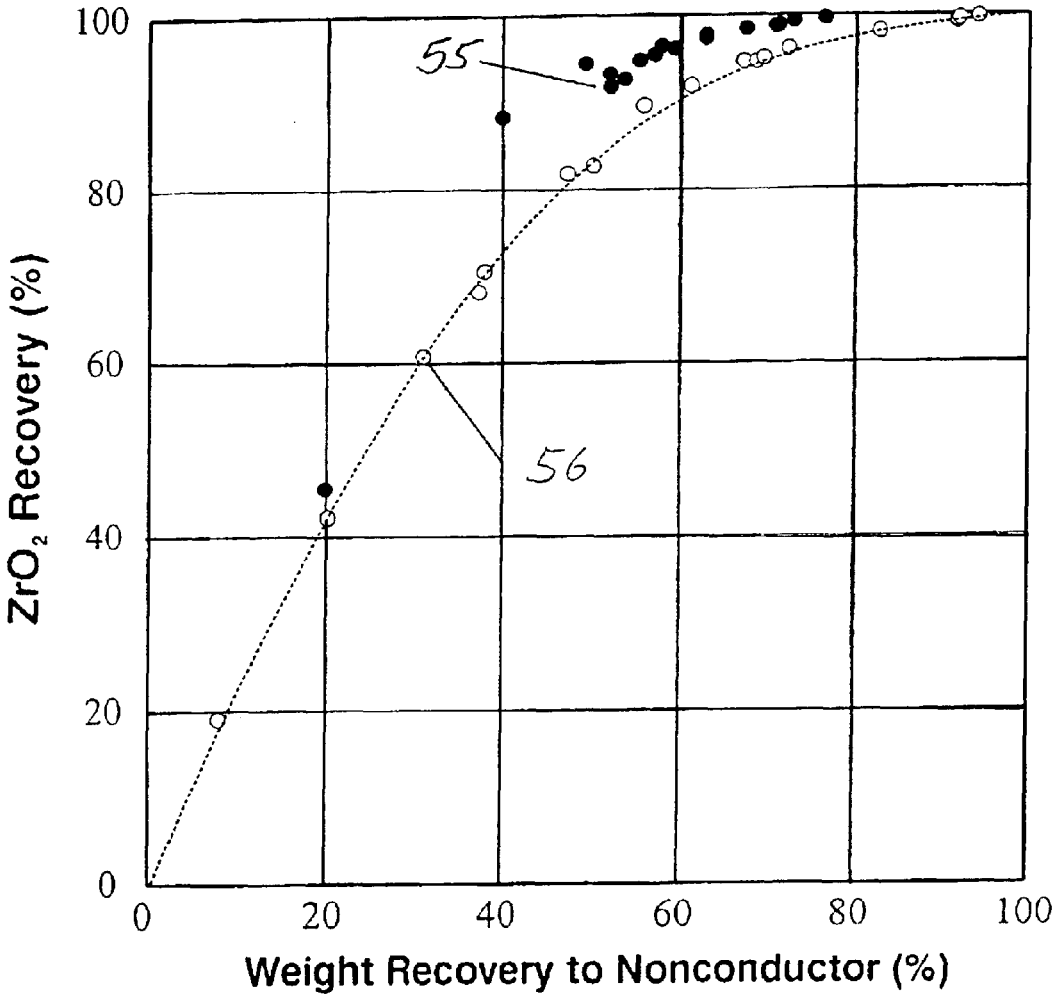
FIG. 9 illustrates the percentage recoveries of nonconductor $ZrO_2$ to the percentage recovery by weight of other nonconductors.

FIG. 8 illustrates the percentage recoveries of conductor $TiO_2$ to the percentage recovery by weight of nonconductors 53, 54 for an electrostatic separator employing the present assembly 11 vs. an electrostatic separator not employing the present assembly 11, respectively. Likewise, FIG. 9 illustrates the percentage recoveries of nonconductor $ZrO_2$ to the percentage recovery by weight of other nonconductors 55, 56 for an electrostatic separator employing the present assembly 11 vs. an electrostatic separator not employing the present assembly 11, respectively.

Graphs A and B, shown hereinbelow, illustrate four samples of electrostatic separation of a conventional separator with its electrode assembly compared to such separator retrofitted with the electrode assembly of this invention 11. Such graphs show, for example, substantial improvements in $TiO_2$ rejection from a Zircon, $ZrO_2$ feed stream.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

GRAPH A

| Compound | Conductor w/o Electrode | Conductor w/ Electrode | NonConductor w/o Electrode | NonConductor w/ Electrode |
|---|---|---|---|---|
| TiO2 | 23.38 | 63.20 | 1.92 | 1.54 |
| Zr2 + HfO2 | 23.90 | 6.88 | 22.34 | 20.03 |
| SiO2 | 34.28 | 6.99 | 57.60 | 58.89 |
| Al2O3 | 9.05 | 2.09 | 13.54 | 13.19 |
| Fe2O3 | 6.10 | 17.32 | 3.01 | 2.75 |
| Uranium | 0.0173 | 0.0102 | 0.0161 | 0.0121 |
| Thorium | 0.0576 | 0.0269 | 0.0538 | 0.0477 |
| CaO | 0.15 | 0.06 | 0.18 | 0.17 |
| MgO | 0.28 | 0.12 | 0.38 | 0.36 |
| P2O5 | 0.48 | 0.28 | 0.43 | 0.39 |
| MnO | 0.28 | 0.74 | 0.16 | 0.13 |
| Nb2O5 | 0.07 | 0.19 | 0.00 | 0.00 |
| ZrO2 | 23.44 | 6.75 | 21.90 | 19.65 |
| HfO2 | 0.46 | 0.13 | 0.44 | 0.39 |
| Y2O3 | 0.10 | 0.04 | 0.10 | 0.09 |
| MnO2 | 0.35 | 0.90 | 0.20 | 0.16 |
| V2O5 | 0.06 | 0.11 | 0.05 | 0.04 |
| Cr2O3 | 0.00 | 0.06 | 0.00 | 0.00 |
| As2O5 | 0.04 | 0.02 | 0.04 | 0.03 |
| ZnO | 0.08 | 0.03 | 0.10 | 0.09 |
| U3O8 | 0.0205 | 0.0120 | 0.0190 | 0.0142 |
| ThO2 | 0.0655 | 0.0307 | 0.0613 | 0.0543 |
| PbO | 0.00 | 0.01 | 0.00 | 0.00 |
| SO3 | 0.00 | 0.00 | 0.02 | 0.00 |
| CeO2 | 0.46 | 0.28 | 0.40 | 0.39 |
| SUM | 99.22 | 99.40 | 100.62 | 98.38 |

GRAPH B

| Compound | Conductor w/o Electrode | Conductor w/ Electrode | NonConductor w/o Electrode | NonConductor w/ Electrode |
|---|---|---|---|---|
| TiO2 | 37.60 | 65.87 | 2.26 | 2.35 |
| Zr2 + HfO2 | 17.92 | 6.62 | 21.92 | 21.09 |
| SiO2 | 24.51 | 6.43 | 54.10 | 55.93 |
| Al2O3 | 7.36 | 2.10 | 14.50 | 14.78 |
| Fe2O3 | 9.03 | 15.16 | 3.31 | 3.35 |
| Uranium | 0.0142 | 0.0069 | 0.0145 | 0.0142 |
| Thorium | 0.0427 | 0.0232 | 0.0547 | 0.0537 |
| CaO | 0.13 | 0.07 | 0.19 | 0.17 |
| MgO | 0.23 | 0.11 | 0.41 | 0.43 |
| P2O5 | 0.40 | 0.28 | 0.44 | 0.43 |
| MnO | 0.45 | 0.71 | 0.19 | 0.17 |
| Nb2O5 | 0.10 | 0.17 | 0.00 | 0.00 |
| ZrO2 | 17.58 | 6.49 | 21.50 | 20.68 |
| HfO2 | 0.34 | 0.13 | 0.42 | 0.41 |
| Y2O3 | 0.07 | 0.03 | 0.10 | 0.10 |
| MnO2 | 0.56 | 0.86 | 0.23 | 0.21 |
| V2O5 | 0.09 | 0.11 | 0.05 | 0.05 |
| Cr2O3 | 0.01 | 0.06 | 0.00 | 0.00 |
| As2O5 | 0.03 | 0.01 | 0.04 | 0.03 |
| ZnO | 0.07 | 0.03 | 0.10 | 0.10 |
| U3O8 | 0.0168 | 0.0081 | 0.0170 | 0.0167 |
| ThO2 | 0.0486 | 0.0264 | 0.0622 | 0.0611 |
| PbO | 0.00 | 0.00 | 0.00 | 0.00 |
| SO3 | 0.00 | 0.00 | 0.00 | 0.00 |
| CeO2 | 0.37 | 0.26 | 0.42 | 0.43 |
| SUM | 99.05 | 98.94 | 98.41 | 99.77 |

What is claimed as new and what it is desired to secure by Letters Patent of the United States is:

1. In a high-tension electrostatic separator for separating particulate materials based upon conductivity having an electrode assembly, said assembly comprising:

a pair of oppositely spaced end panels;

an elongate corona support member having opposed end portions disposed inwardly of and supported by respective said end panels;

a pair of spaced spacers connected to and laterally extending from said corona support member;

an elongate conductive wire extending along a length of said corona support member and extending between said pair of spacers, means for supporting said wire between said spacers and adjusting a tension of said wire to a predetermined tension; and a plurality of elongate static electrodes spaced from said wire and extending substantially parallel to said wire, said plurality of static electrodes being spaced from each other and having opposite end portions connected to said pair of end panels;

said end panels having a plurality of spaced holes respectively receiving said static electrodes therethrough and for supporting same in a substantially parallel arrangement to each other; and an elongate mounting support member spaced from said corona support and extending through and outwardly of said end panels.

2. The assembly of claim 1, further including a conductive plate attached to one said end panel and engaging an end of each said electrode to enhance uniform electrification of said wire and said static electrodes.

3. The assembly of claim 2, wherein each of said end panels has a substantially planar inner surface for connecting to said conductive plate, said conductive plate having a plurality of spaced holes aligned with the respective holes of said end panels and for receiving the end portions of said plurality of static electrodes therethrough.

4. The assembly of claim 1, wherein each said spacer has an edge portion disposed spacedly away from said corona support member, each said spacer further having an aperture extending through each said edge portion for receiving a bolt therethrough.

5. The assembly of claim 4, wherein said means for supporting said wire includes a pair of threaded bolts, each said bolt having its threaded end passing through respective said apertures and having a passageway extending laterally through its bolt head for receiving and maintaining an end of said wire, respectively, said bolts being rotatable to wrap said wire therearound and adjust tension of said wire.

6. The assembly of claim 5, further including a pair of end connectors attached between respective said end portions of said corona support member and said end panels, said end connectors having a pair of threaded holes aligned with each other respectively for receiving said respective bolts therethrough.

7. The assembly of claim 6, wherein said end connectors are coated with insulating material.

8. The assembly of claim 1, further including at least one support panel spaced along the length of said corona support member and having a notch for receiving said corona support member therethrough and maintaining same in a fixed position, said at least one support panel having a hole therethrough for receiving and maintaining said elongate mounting support member parallel to said support members.

9. The assembly of claim 1, further including a pair of opposed end shields spaced outwardly from respective said end panels, said mounting support member passing through and being connected to said end shields.

10. The assembly of claim 9, wherein each said end shield includes a first slot for receiving a corresponding end of said elongate mounting support member to thereby adjustably position said assembly on a frame of an electrostatic separator.

11. The assembly of claim 10, further including a pair of threaded fasteners each having one end connected to said end panels respectively, said end shields further including second slots spaced from respective said first slots, said threaded fasteners being removably attachable to said second slots respectively for assisting to connect said end shields to said end panels respectively.

12. The assembly of claim 1, wherein said corona support member is formed from a single piece of material angled to form a substantially L-shape.

13. The assembly of claim 1, wherein said plurality of static electrodes are coated with non-conductive material.

14. The assembly of claim 1, wherein said corona support member and said end panels are covered with dielectric material and said spacers are formed from dielectric material.

15. The assembly of claim 1, wherein said spacers are formed from dielectric material.

16. The assembly of claim 1, wherein said corona support member has a central longitudinal axis, said corona support member being selectively rotatable about said axis.

17. An electrode assembly for separating particulate materials based upon conductivity comprising:

a pair of oppositely spaced end panels;

an elongate corona support member having opposed end portions disposed inwardly of and supported by respective said end panels;

a pair of spaced spacers connected to and laterally extending from said corona support member;

an elongate conductive wire extending along a length of said corona support member and extending between said pair of dielectric spacers, means for supporting said wire between said spacers and adjusting a tension of said wire to a predetermined tension; and a plurality of elongate static electrodes spaced from said wire and extending substantially parallel to said wire, said plurality of static electrodes being spaced from each other and having opposite end portions connected to said pair of end panels;

said end panels having a plurality of spaced holes respectively receiving said static electrodes therethrough and for supporting same in a substantially parallel arrangement to each other;

an elongate mounting support member spaced from said corona support and extending through and outwardly of said end panels; and an elongate support bar extending substantially parallel to said static electrodes and having opposite end portions passing through said end panels for connecting to a frame of an electrostatic separator.

18. The electrode assembly of claim 17, further including a conductive plate attached to one said end panel and engaging an end of each said electrode to enhance uniform electrification of said wire and said static electrodes.

19. The assembly of claim 18, wherein each of said end panels has a substantially planar inner surface for connecting to said at least one conductive plate, said at least one conductive plate having a plurality of spaced holes aligned with the respective holes of said end panels and for receiving the end portions of said plurality of static electrodes therethrough.

20. The assembly of claim 18, further including at least one support panel spaced along the length of said corona support member and having a notch for receiving said corona support member therethrough and maintaining same in a fixed position, said at least one support panel having a hole therethrough for receiving and maintaining said elongate mounting support member substantially parallel to said corona support member.

21. The electrode assembly of claim 17, wherein said corona support member is formed from a single piece of conductive material angled to form a substantially L-shape.

22. The electrode assembly of claim 17, wherein said means for supporting said wire includes a pair of threaded bolts and each said spacer has an aperture extending therethrough, each said bolt having its threaded end passing through respective said apertures and having a passageway extending laterally through its bolt head for receiving and maintaining an end of said wire, respectively, said bolts being rotatable to wrap said wire therearound and adjust tension of said wire.

23. The electrode assembly of claim 22, further including a pair of end connectors attached between respective said end portions of said corona support member and said end panels, said end connectors having a pair of threaded holes aligned with each other respectively for receiving said respective bolts therethrough.

* * * * *